US006022651A

United States Patent [19]

Cho

[11] Patent Number: 6,022,651

[45] **Date of Patent: *Feb. 8, 2000**

[54] BLACK MATRIX AND A PHOSPHOR SCREEN FOR A COLOR CATHODE-RAY-TUBE AND PRODUCTION THEREOF

[75] Inventor: Jong Ho Cho, Seoul, Rep. of Korea

[73] Assignee: Samsung Display Devices Co., Ltd., Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/592,961

[22] Filed: Jan. 29, 1996

[30] Foreign Application Priority Data

Nov. 7, 1995 [KR] Rep. of Korea ..... 95-40103

[51] Int. Cl.[7] ..... G03G 13/10

[52] U.S. Cl. ..... 430/25; 430/23; 430/29; 430/114; 430/117

[58] Field of Search ..... 430/25, 23, 28, 430/29, 117, 119, 114, 42, 31

[56] References Cited

U.S. PATENT DOCUMENTS 3,475,169 10/1969 Lange .
4,095,134 6/1978 Strik ..... 313/470
4,921,767 5/1990 Datta et al. ..... 430/23
5,199,984 4/1993 Jeong ..... 106/474
5,474,866 12/1995 Ritt et al. ..... 430/23
5,569,571 10/1996 Lim et al. ..... 430/25

FOREIGN PATENT DOCUMENTS 1498602 1/1978 European Pat. Off. .

OTHER PUBLICATIONS

Patent & Trademark English–Language Translation of JP 49–42702 (Pub. Feb. 16, 1974).

Caplus Abstract AN 1975 : 450734 of Japanese Patent 49042702 B4 (Pub Feb.1974).

P.M. Borsenberger & D.S. Weiss *Organic Photoreceptors for Imaging Systems*, Marcel Dekker, Inc, NY (1993), p. 10.

*Primary Examiner*—Janis L. Dote
*Attorney, Agent, or Firm*—Christie, Parker & Hale, LLP

[57] ABSTRACT

The present invention provides with a black matrix, a phosphor screen, and a method of manufacturing thereof. For a method of manufacturing the black matrix formed on the inner surface of a panel of a color CRT, a photoresist is not used, but a wet electrophotographic method was employed, using graphite for a main component of the black matrix materials, and forming a phosphor screen by a dry electrophotographic method to improve the quality of a color cathode-ray-tube.

6 Claims, 6 Drawing Sheets

(2 of 6 Drawing Sheet(s) Filed in Color)

BLACK MATRIX AND A PHOSPHOR SCREEN FOR A COLOR CATHODE-RAY-TUBE AND PRODUCTION THEREOF

BACKGROUND OF THE INVENTION

1. Field of the Invention

The present invention relates to a black matrix, a phosphor screen, and a method of manufacturing thereof, and more particularly to developing the black matrix formed on the inner surface of a panel of a color cathod-ray-tube (CRT) by a wet electrophotographic method, using graphite for a main component of the black matrix materials, and forming a phosphor screen by a dry electrophotographic method to improve the quality of a color cathode-ray-tube (CRT).

2. Description of the Related Art

In a conventional shadow-mask-type CRT, graphic images are reproduced by red, green, and blue electron beams emitted from means for producing them which pass through a hole of a shadow mask, converge into a point, and collide with red, green, and blue phosphors formed on a phosphor screen of an inner surface of a panel.

The phosphor screen comprises red, green, and blue phosphors which have a pattern and black matrix which is formed on the same surface and between the phosphors. Generally, the black matrix is a photo-absorptive layer produced by using photoresisting effect of a photoresist.

The black matrix for a color CRT is produced by packing illuminescent absorptive materials between phosphors. The black matrix prevents the contrast of the CRT from decreasing, which is caused by luminescence of aluminium layer occurring when the electrons scattered around the inner panel of the CRT and the hole of a shadow mask collide with the phosphor screen. The black matrix also prevents the chromaticity from decreasing, which is caused by luminescence of dots and stripes of the phosphors when the neighboring dots and stripes are radiated by the electron beams.

In general, a process of using a photoresist for forming a black matrix takes the following steps.

A photoresist is coated on the inner surface of a panel, dried by heat or other means, and exposed by irradiation of ultraviolet rays through mask slots. The exposed panel is washed and developed to remove the unexposed photoresist and then dried. Black matrix materials are coated on the panel on which the photoresist-coated portion and photoresist-uncoated portion are regularly arranged. Then, the black matrix is produced by etching the panel. This process, however, has problems of complexity and much expenditures.

To solve the above problems, U.S. Pat. No. 4,921,767 discloses a method of manufacturing a black matrix and a phosphor screen by adjusting an electrophotographic method to reduce the number of steps in the process. A conventional process for manufacturing a black matrix and a phosphor screen for a color CRT by a dry electrophotographic method is described in FIG. 1 as follows.

A conductive layer and a photoconductive layer are coated on a washed panel, and then an electrical charge is established on the panel. The charged panel is exposed and developed by a dry electrophotographic method. A black matrix is fixed by irradiating infrared rays from an IR lamp on the panel. Electrostatically charged red, green, and blue phosphors are fixed on the panel on which the black matrix is not formed by a dry electrophotographic method.

According to the disclosure, the black matrix is mainly composed of carbon black and contains proper pigments, such as Fe—Mn oxide, etc., a polymer, and a charge control agent as subsidiary components. The mixture is dissolved by heat and mixed. The size of the mixture is about 5 $\mu$m.

However, the size of the carbon black used in the disclosure is so large that the boundary of the pattern of the black matrix is not properly formed. The large size of the carbon black also causes a problem of micro-particle scattering around the pattern. Moreover, it is difficult to form a thin and dense layer on the inner surface of the panel because the carbon black used in the disclosure has a disordered hexagonal layer structure.

SUMMARY OF THE INVENTION

The present invention is to solve the above problems in the conventional art. The present invention provides with a process for preparing a black matrix by introducing a wet electrophotographic method improving substantially the steps of the process. And the use of graphite as a main component of black matrix materials prevents the scattering and improves the fineness of the boundary of the pattern of the black matrix and improves the cohesiveness to the panel and hiding power, an ability which prevents a light emitted when the black matrix and the neighboring phosphors are luminescent by electron beams from passing through the pattern of the black matrix, because a thin and dense black matrix layer is formed on the panel. The present invention also provides a phosphor screen where the above black matrix is adjusted to a dry electrophotographic method.

To solve the above problems, the present invention provides with a black matrix and a process for preparing thereof comprising the steps of coating a conductive layer on the inner surface of a panel for a color CRT, overcoating a photoconductive layer on said conductive layer, establishing an electrostatic charge on said photoconductive layer, exposing selected areas of said photoconductive layer, developing the exposed panel with a light-absorptive material including an isoparaffin solvent, graphite, a polymer, and a charge control agent, removing a residual solution on the developed panel, and fixing said light-absorptive material on the panel. The present invention also provides a phosphor screen and a process for preparing thereof wherein electrostatically charged red, green, and blue phosphors are formed on the photoconductive layer on which the black matrix is not formed.

In the present invention, it is preferable that the electrostatic charge is a corona electrical charging, the thickness of the black matrix is about 1 to 3 $\mu$m, and the average particle diameter of the graphite is 0.5 to 1.5 $\mu$m. The residual solution is preferably dried by a vacuum absorption method and the fixing of the light-absorptive material is preferably performed by using an infrared lamp as a heat source.

The file of this patent contains at least one drawing executed in color. Copies of this patent with color drawing (s) will be provided by the Patent and Trademark Office upon request and payment of the necessary fee.

BRIEF DESCRIPTION OF THE DRAWINGS

The accompanying drawings, which are incorporated in and constitute a part of this specification, illustrate embodiments of the invention and, together with the description, serve to explain the objects, advantages, and principles of the invention.

In the drawings.

DETAILED DESCRIPTION OF THE PREFERRED EMBODIMENTS

In accordance of FIGS. 2 and 3, a representative example is described as follows.

Figure 1:
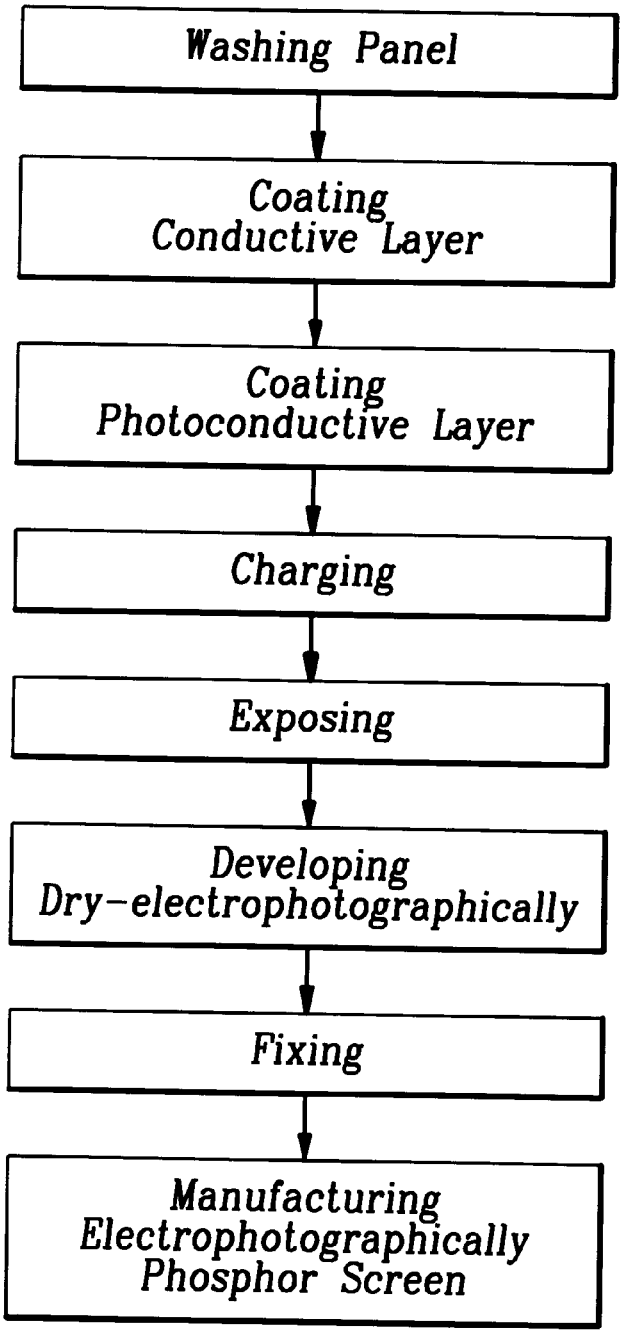
FIG. 1 (Prior Art)
FIG. 1 is a flow chart of a conventional process for manufacturing a color CRT in which a black matrix is produced by a dry electrophotographic method and then a phosphor screen is produced by a dry electrophotographic method.
Figure 2:
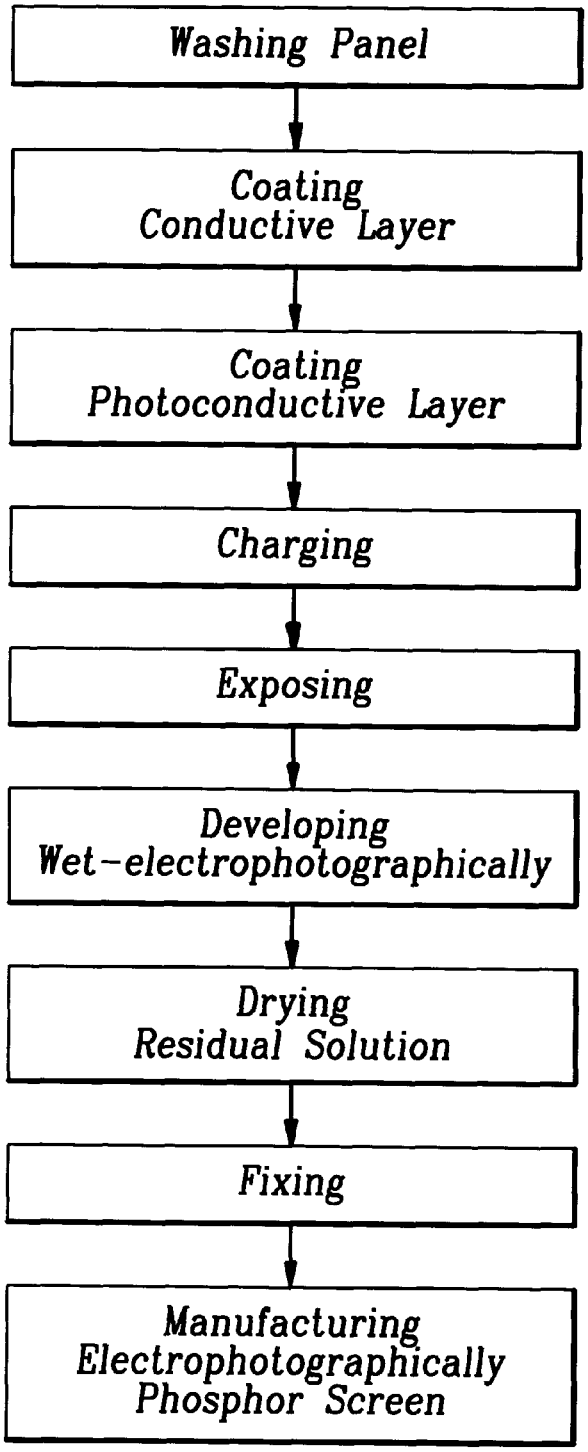
FIG. 2 is a flow chart of a process for manufacturing a color CRT in which a black matrix is produced by a wet electrophotographic method and then a phosphor screen is produced by a dry electrophotographic method according to the present invention.
Figure 3:
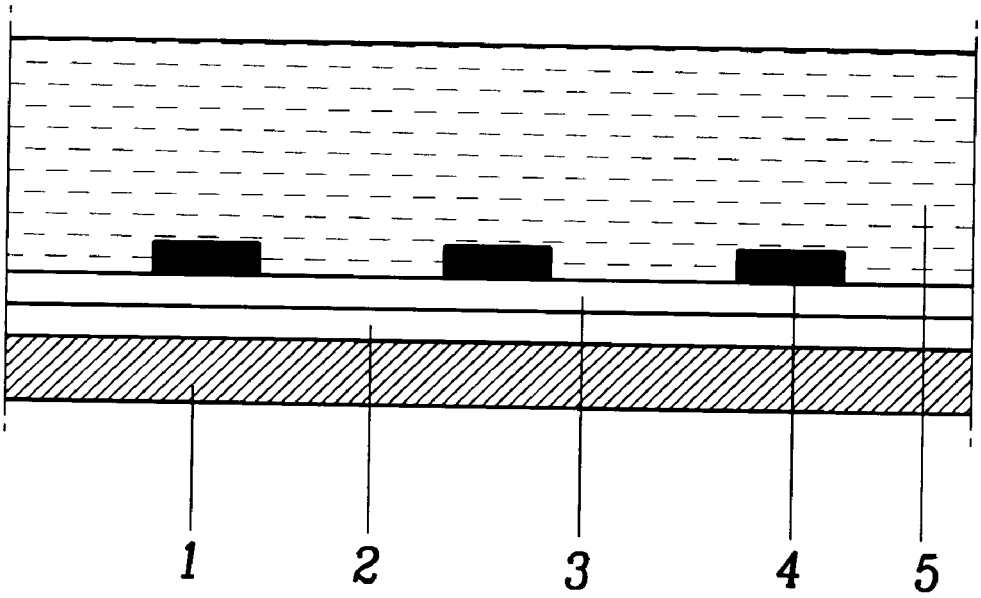
FIG. 3 is a section of a black matrix which is being developed by a wet electrophotographic method according to the present invention.

FIG. 2 is a flow chart of a process for manufacturing a color CRT in which a black matrix is produced by a wet electrophotographic method and then a phosphor screen is produced by a dry electrophotographic method according to the present invention, and FIG. 3 is a section of a black matrix which is being developed by a wet electrophotographic method according to the present invention.

As shown in FIGS. 2 and 3, a panel 1 is washed and 1 to 2 μm of conductive layer 2 and 2 to 6 μm of photoconductive (3 of FIG. 3) layer is coated on it. An electric charge is established on the photoconductive layer and a selected area of the photoconductive layer is exposed. The exposed panel is developed with a light-absorptive material including an isoparaffin solvent (5 of FIG. 3) having a thickness of 500 μm containing 0.5 to 1.5 μm of graphite used as a main component, a polymer, and a charge control agent to produce 1 to 3 μm of a black matrix. The residual solution of the developed panel is dried by a vacuum absorption method and the light-absorptive material is fixed by an infrared lamp as a heat source to produce a black matrix 4. To produce a phosphor screen for a color CRT, electrostatically charged red, green, and blue phosphors are fixed on the photoconductive layer on which the black matrix is not formed by a dry electrophotographic method.

Preferable working examples and reference examples are described below. These examples are exemplary only, and the present invention is not restricted to the scope of the example.

WORKING EXAMPLE 1

A panel was washed and a conductive layer and a photoconductive layer were coated on it. A corona electrical charging was established on the photoconductive layer and a selected area of the photoconductive layer was exposed. The exposed panel was developed with a light-absorptive material including an isoparaffin solvent containing 0.5 to 1.5 μm of graphite used as a main component, a polymer, and a charge control agent to produce a black matrix. The residual solution of the developed panel was dried by a vacuum absorption method and the light-absorptive material was fixed by an infrared lamp as a heat source to produce a black matrix.

WORKING EXAMPLE 2

A black matrix was produced by the same method of the working example 1, and electrostatically charged red, green, and blue phosphors were fixed on the panel on which the black matrix was not formed by a dry electrophotographic method to produce a phosphor screen.

REFERENCE EXAMPLE 1

A panel was washed and a conductive layer and a photoconductive layer were coated on it. A corona electrical charging was established on the photoconductive layer and a selected area of the photoconductive layer was exposed. The exposed panel was developed with a light-absorptive material including an isoparaffin solvent containing carbon black used as a main component, a polymer, and a charge control agent to produce a black matrix. The residual solution of the developed panel was dried by a vacuum absorption method and the light-absorptive material was fixed by an infrared lamp as a heat source to produce a black matrix.

REFERENCE EXAMPLE 2

A black matrix was produced by the same method of the reference example 1, and electrostatically charged red, green, and blue phosphors were fixed on the panel on which the black matrix was not formed by a dry electrophotographic method to produce a phosphor screen.

REFERENCE EXAMPLE 3

A panel was washed and a conductive layer and a photoconductive layer were coated on it. A corona electrical charging was established on the photoconductive layer and a selected area of the photoconductive layer was exposed. The exposed panel was developed with carbon black used as a main component, a polymer, and a charge control agent by a dry electrophotographic method to produce a black matrix. The light-absorptive material was fixed by an infrared lamp as a heat source to produce a black matrix.

REFERENCE EXAMPLE 4

A black matrix was produced by the same method of the reference example 3, and electrostatically charged red, green, and blue phosphors were fixed on the panel on which the black matrix was not formed by a dry electrophotographic method to produce a phosphor screen.

REFERENCE EXAMPLE 5

A panel was washed and a conductive layer and a photoconductive layer were coated on it. A corona electrical charging was established on the photoconductive layer and a selected area of the photoconductive layer was exposed. To develop the exposed panel to a black matrix, a light-absorptive material including graphite used as a main component, a polymer, and a charge control agent by a dry electrophotographic method were used.

Figure 4A:
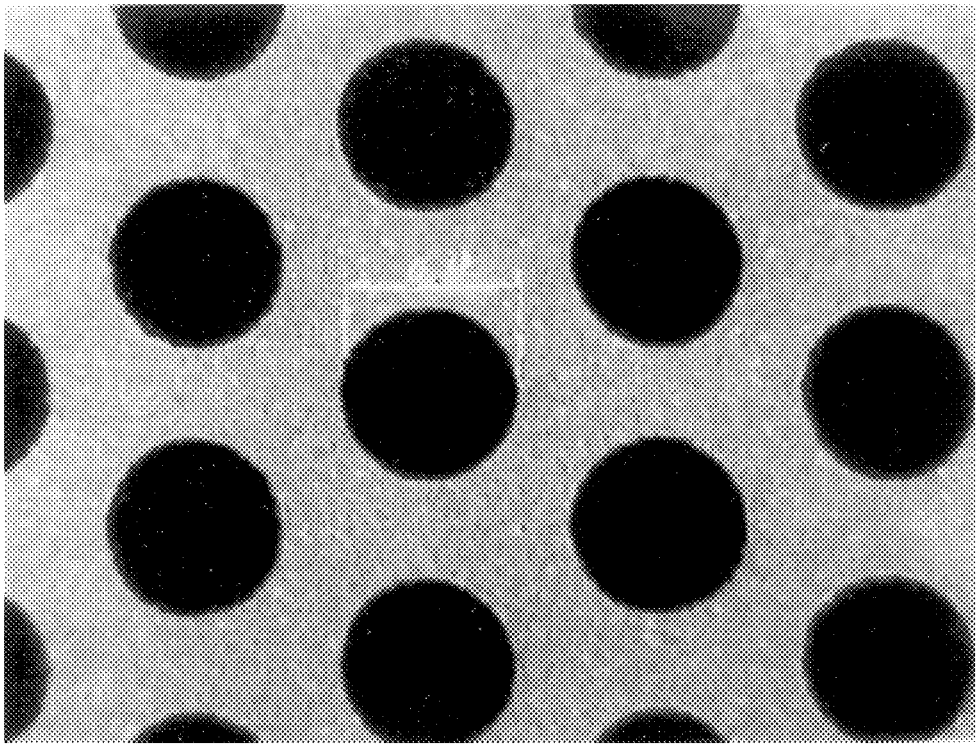
FIG. 4*a* is an electron microphotograph in which the black matrix mainly composed of graphite and produced by a wet electrophotographic method according to the present invention is shown.

FIG. 4*a* is an electron microphotograph in which the black matrix mainly composed of graphite and produced by a wet electrophotographic method according to the present invention is shown. As shown in the electron microphotograph, the diameter of a dot is 0.11 mm, the boundary of dots is fine, and the density of the graphite is excellent.

Figure 4B:
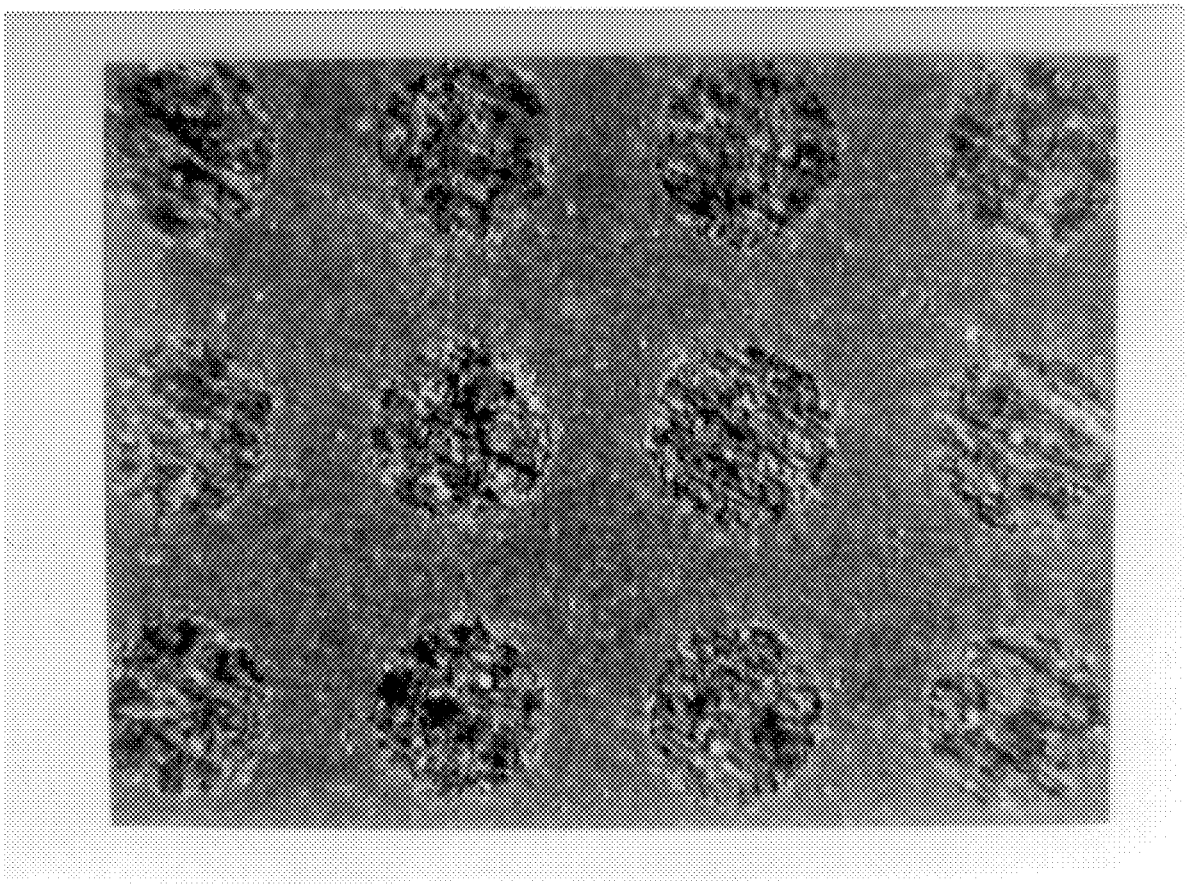
FIG. 4*b* is an electron microphotograph in which the black matrix mainly composed of carbon black and produced by a wet electrophotographic method is shown.

FIG. 4*b* is an electron microphotograph in which the black matrix mainly composed of carbon black and produced by a wet electrophotographic method according to the reference example 1 is shown. As shown in the electron microphotograph, the diameter of a dot is 0.11 mm and the boundary of dots is somewhat fine but the density of the carbon black is inferior to that of FIG. 4*a*.

Figure 4C:
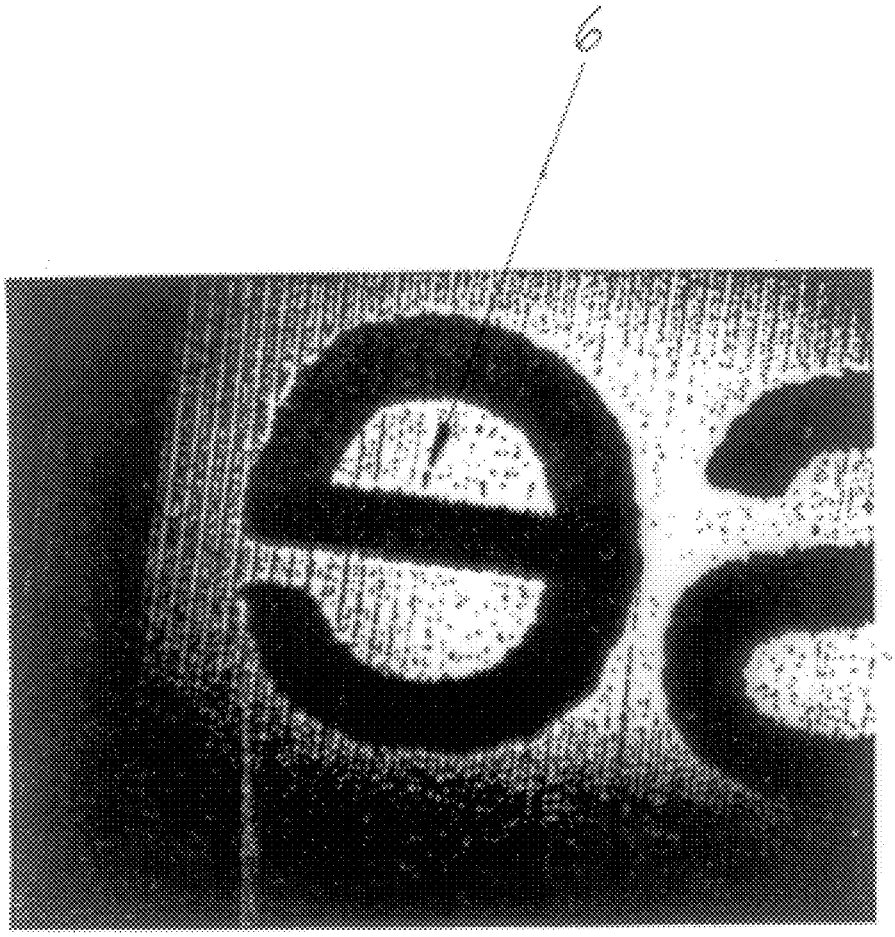
FIG. 4*c* is an electron microphotograph in which the black matrix mainly composed of carbon black and produced by a dry electrophotographic method is shown.

FIG. 4*c* is an electron microphotograph in which the black matrix mainly composed of carbon black and produced by a dry electrophotographic method according to the reference example 3 is shown. As shown in the electron microphotograph, the thickness of the character is 0.3 mm, the boundary of dots is not fine. Moreover, the scattering 6 which is a cause of black dot defect is found.

The process using graphite as a main component and developing by a dry electrophotographic method according to the reference example 5 can not form a pattern of a black matrix.

The results of examination for the phosphor screens of working example 2, reference examples 2 and 4 are listed in the following Table.

TABLE

| | Fineness of the Boundary of Dots | Scattering | Density of BM |
|---|---|---|---|
| Working Exam. 2 | ±1 μm | Not found | Black |
| Reference Exam. 2 | ±1 μm | Not found | Grey black |
| Reference Exam. 4 | ±5 μm | Many | Grey black |

It will be apparent to those skilled in the art that various modifications and variations can be made in the disclosed process and product without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A process for preparing a phosphor screen, comprising the steps of:

coating a conductive layer on an inner surface of a panel for color CRT;

overcoating a photoconductive layer on said conductive layer;

establishing an electrostatic charge on said photoconductive layer;

selectively irradiating said photoconductive layer with light;

developing the photoconductive layer with a light-absorptive material including an isoparaffin solvent, graphite, a polymer, and a charge control agent;

removing residual light-absorptive material on the developed photoconductive layer;

fixing said light-absorptive material on the developed photoconductive layer to form a black matrix; and fixing electrostatically charged red, green and blue phosphor particles on the panel by a dry electrophotographic method where the black matrix is not formed.

2. The process of claim 1, wherein the electrostatic charge is a corona electrical charging.

3. The process of claim 1, wherein the thickness of the black matrix is about 1 to 3 μm.

4. The process of claim 1, wherein the average particle diameter of the graphite is 0.5 to 1.5 μm.

5. The process of claim 1, wherein the residual light-absorptive material is removed by a vacuum absorptive method.

6. The process of claim 1, wherein the fixing is performed by using an infrared lamp as a heat source.

* * * * *